United States Patent [19]

Pecchioni

[11] 4,248,016

[45] Feb. 3, 1981

[54] INTEGRAL UNIT COMPRISING A RAISABLE AND TILTABLE DOOR PANEL MEMBER AND A FRAME STRUCTURE THEREFOR CONTAINING THE DRIVING MECHANISM

[76] Inventor: Vito Pecchioni, 102 Manuel Lemos St., Maipu, Mendoza, Argentina

[21] Appl. No.: 45,695

[22] Filed: Jun. 5, 1979

[30] Foreign Application Priority Data

Jun. 12, 1978 [AR] Argentina ..... 272575

[51] Int. Cl.[3] ..... E05F 15/00

[52] U.S. Cl. ..... 49/200; 49/199

[58] Field of Search ..... 49/199, 200, 203, 204, 49/197

[56] References Cited

U.S. PATENT DOCUMENTS

| | | | |
|---|---|---|---|
| 2,277,932 | 3/1942 | Mowers et al. | 49/199 |
| 2,612,371 | 9/1952 | Hall | 49/199 |
| 3,774,341 | 11/1973 | Schoonover et al. | 49/200 |

FOREIGN PATENT DOCUMENTS

| | | | |
|---|---|---|---|
| 1498902 | 9/1967 | France | 49/200 |

*Primary Examiner*—Kenneth Downey
*Attorney, Agent, or Firm*—Fleit & Jacobson

[57] ABSTRACT

An integral unit is provided comprising a raisable and tiltable door panel member and a frame structure therefor containing the driving mechanism. All the components of the driving mechanism are not only contained within the door frame member, but are also entirely concealed therewithin so that the integral unit has an agreeable and esthetic appearance, both from the front and from the rear side. Nobody can tamper with the driving mechanism, neither from its front nor from its rear side. No greased nor oiled components (such as chains, cables and the like) are exposed, with which the user may soil its clothes or its hands when passing by. The entire unit may be manufactured and its operation tested at the factory, and thereafter it can be assembled at the site of use by only fixing the frame in position in the corresponding wall aperture. The only additional operation which must be made thereafter is to connect the wires, already provided in the frame, to the corresponding electric mains through corresponding control means for energizing the motor (also contained within the frame) which must drive the moving parts. Thus an absolute minimum of installation work must be performed at the site of use, while all the assembling and testing work is done at the factory. The frame structure is designed so as to be able to contain all the other components and these are arranged in such a manner within the hollow frame structure that they require a true minimum of space, without any part protruding from the frame. The driving mechanism may be also provided with clutch means which in emergency situations allows the operation by hand of the door panel member.

7 Claims, 3 Drawing Figures

INTEGRAL UNIT COMPRISING A RAISABLE AND TILTABLE DOOR PANEL MEMBER AND A FRAME STRUCTURE THEREFOR CONTAINING THE DRIVING MECHANISM

BACKGROUND OF THE INVENTION

1. Field of the Invention

This invention relates in general to an integral unit comprising a raisable and tiltable door panel member, and a frame structure therefor integrally containing the driving mechanism. More particularly, the invention relates to an integral unit of this kind which may be entirely manufactured and tested at the factory, while at the site of use it is only necessary to mount the unit in the wall aperture, and then connect the electrical supply wires to the mains.

2. Description of the Prior Art

The applicant is not aware of any pertinent prior art. The only patent which is of his knowledge is Argentine Pat. No. 209.732 granted to Angel Tregnaghi on May 31, 1977. This patent deals also with a raisable an pivotable door panel for similar purposes, but it can not be held as prior art against the present invention, since it is not an integral unit. The frame must be first fitted and fixed in the wall aperture, thereafter the door panel must be mounted in the frame, and thereafter the entire driving mechanism must be mounted on the inside face of the door panel. All the components of the driving mechanism are exposed and thus the clothes of the user may be soiled by oil and grease, and his clothes and/or his hands may be catched by moving parts of the mechanism. Furthermore, a car thief who enters the garage through a rear door by way of the house, may make temporary electrical connections to operate the door panel from the inside since all the wiring is exposed. Thus said Argentine patent offers none of the advantages of the present invention and the construction of the driving mechanism is certainly entirely different from what is herein proposed.

SUMMARY OF THE INVENTION

The main object of the invention is to provide an integral unit comprising a raisable and pivotable door panel, and a frame structure therefor containing the driving mechanism.

This object is attained providing an upper transversal hollow frame member within which the driving means, reduction gear-box means, clutch means, gear wheels and horizontally running driving chains, belts or cables are arranged in such a way that all these components are concealed within said upper frame member, while vertically running chains, belts or cables are provided within corresponding hollow door jamb members of the frame structure and the upper ends of which are united with the lateral ends of said upper frame member, these chains, belts or cables being also entirely concealed within the inner space of said door jamb members.

According to a particular embodiment, to allow the confinement of the driving mechanism within the hollow upper frame member without unduly increasing its thickness, the driving motor is mounted on the inner face of a wall of the upper frame member with its shaft parallel to the longitudinal axis of said upper frame member, said shaft being coupled to the input of a gear-box capable of reducing the revolutions of the motor. The output shaft of the gear-box is perpendicularly arranged with respect to the longitudinal axis of the upper frame member. On said output shaft clutch means are mounted. On the output shaft of the clutch means a first gear wheel and a first chain pinion are fixedly mounted. The gear wheel meshes with a second similar gear wheel having a shaft freely rotatably mounted in the upper frame member. On this latter shaft a second chain pinion gear is fixedly mounted, this chain pinion being similar to the first one. Near each end of the upper frame member a first third and a second chain wheels are each fixedly mounted on a corresponding shaft freely rotatably mounted in the upper frame member, these shafts being directed perpendicularly to the longitudinal axis of the upper frame member. On each of these shafts corresponding third and fourth chain pinions are mounted. Over each of these latter chain pinions pass corresponding first and second chains running vertically in the downward direction within the hollow spaces of the door jamb members. One of the lower ends of each of said chains is fixed to one end of a corresponding spring means the other end of which is anchored to a point at or near the lower end of a corresponding one of said door jamb members. The other free end of each chain is provided with a laterally projecting door driving pin which passes freely slidable through a vertical guiding slot provided along substantially the entire height of the inwardly directed face of the corresponding door jamb member. The projecting ends of these door driving pins are rotatably connected to a corresponding point of the opposed lateral edge of the movable door panel member. The points of mounting of the door driving pins on the edges of the door panel members are selected so as to provide an optimum balance of the weights of the upper and the lower portions of the door panel member. In general they will be positioned slightly nearer to the lower edge of the door panel member than to its upper edge.

On the upper face of the upper frame member a first supporting member is fixedly mounted, projecting slightly therefrom. To the projected end of said first supporting member is pivotally connected one end of a link member, the other end of which is pivotally connected to a second support member fixed to a point of the lateral edge of the door panel member substantially near the upper end thereof. To allow a better balanced movement of the door panel member, a complete set of first and second supporting members and link member may be provided at each side thereof.

Thus it can be seen that no moving parts of the driving mechanism are exposed to the outside of the frame members except the door driving pins and the link members, it being highly improbable that the user may come unintentionally into contact therewith. This is one of the objects of this invention. It will also be seen that the present integral unit will offer a highly attractive appearance, since it has no visibly exposed mechanical elements, thus providing a highly esthetic structure, and this is another object of the invention. Furthermore, it may also be appreciated that it offers an integral unit which may be entirely manufactured and tested at the factory and which may be easily mounted at the site of use requiring only the mounting of the unit into the corresponding aperture of a wall of the building and thereafter connecting the driving motor supply wires to the electric mains, this being the main object of the invention.

Thus, a general object of the invention is to provide an integral unit comprising a raisable and tiltable door panel member, and a frame structure therefor containing the driving mechanism.

Another object of the invention is to provide an integral unit of the kind mentioned, which may be entirely manufactured and tested at the factory.

Another object of the invention is to provide an integral unit of the kind mentioned which may be mounted at the site of use in a corresponding aperture in a wall of a building and which, once so mounted, will be ready to operate requiring no other complementary operations than connecting to the mains the wires supplying electrical current to the driving motor through the corresponding control means.

Another object of the invention is to provide an integral unit of the kind mentioned, having all its moving components confined within the internal hollow space of the upper frame member and of the door jamb members, all such components remaining concealed so as to make the unit esthetically more attractive.

Another object of the invention is to provide an integral unit of the kind mentioned which has no exposed moving parts, thus offering more safety to the user and preventing that his clothes and hands may become soiled from contact with oiled or greased moving parts, or may be trapped thereby.

Another object of the invention is to provide an integral unit of the kind mentioned, which is considerably more economical in its mounting at the site of use, since its installation requires only a minimum of workmanship and it can be entirely manufactured and tested at the fractory.

Another object of the invention is to provide an integral unit of the kind mentioned, which may be manually operated in emergency situations, such as failure of the driving mechanism, interruption of the mains current and the like.

These and other objects and advantages of the invention are achieved by providing an integral unit comprising a raisable and tiltable door panel member and a frame structure therefor containing a driving mechanism, the frame comprising an upper frame member and two corresponding door jamb members, and a door panel member which may be raised and simultaneously tilted from its lowered vertical closing position to a raised substantially horizontal opened position, and vice versa, in response to the operation of the driving mechanism, the tilting movement being obtained by means of at least one rigid restraining link member pivotally connected at its upper end to the upper frame member and at its lower end to a corresponding lateral edge of the door panel member at a point located higher than the point at which the lifting force of the driving mechanism is applied, wherein said upper frame member and said door jamb members are hollow and said driving mechanism comprises: (a) an electric driving motor having a shaft; (b) a reduction gear-box having an input shaft and an output shaft, said input shaft being coupled to the driving motor shaft; (c) a first pair of linear flexible transmission members closed upon themselves, each forming a substantially horizontally running closed loop having an inner end near the central region of the upper frame member and an outer end near a corresponding outer end region thereof, the inner end being drivingly coupled to said gear-box output shaft; (d) a second pair of linear flexible transmission members, each forming an upper loop and having two free ends hanging vertically within said hollow door jamb members, the upper loop being drivingly coupled to said outer end of the loop of a corresponding one of said first pair of linear flexible transmission members; (e) a pair of drive coupling members coupling a first of said two free ends of a corresponding one of said second pair of linear flexible transmission members to the corresponding lateral edge of the door panel member at the point thereof to which the lifting force must be applied; and (f) a pair of weight compensating members to each of which the other of said two free ends of a corresponding one of said second pair of linear flexible transmission members is connected; all the components (a) to (f) being entirely contained within the inner spaces of said upper frame member and door jamb members, except that only one end of each of said drive coupling members (e) project through a corresponding longitudinal slot provided along the face of the respective door jamb member opposing said door panel member.

The invention will be better understood through the following description of a presently preferred embodiment thereof and the accompanying drawings.

BRIEF DESCRIPTION OF THE DRAWINGS

In the drawings.

In the different figures the same reference numerals have been used to indicate the same or functionally equivalent components.

DETAILED DESCRIPTION OF A PREFERRED EMBODIMENT OF THE INVENTION

Figure 1:
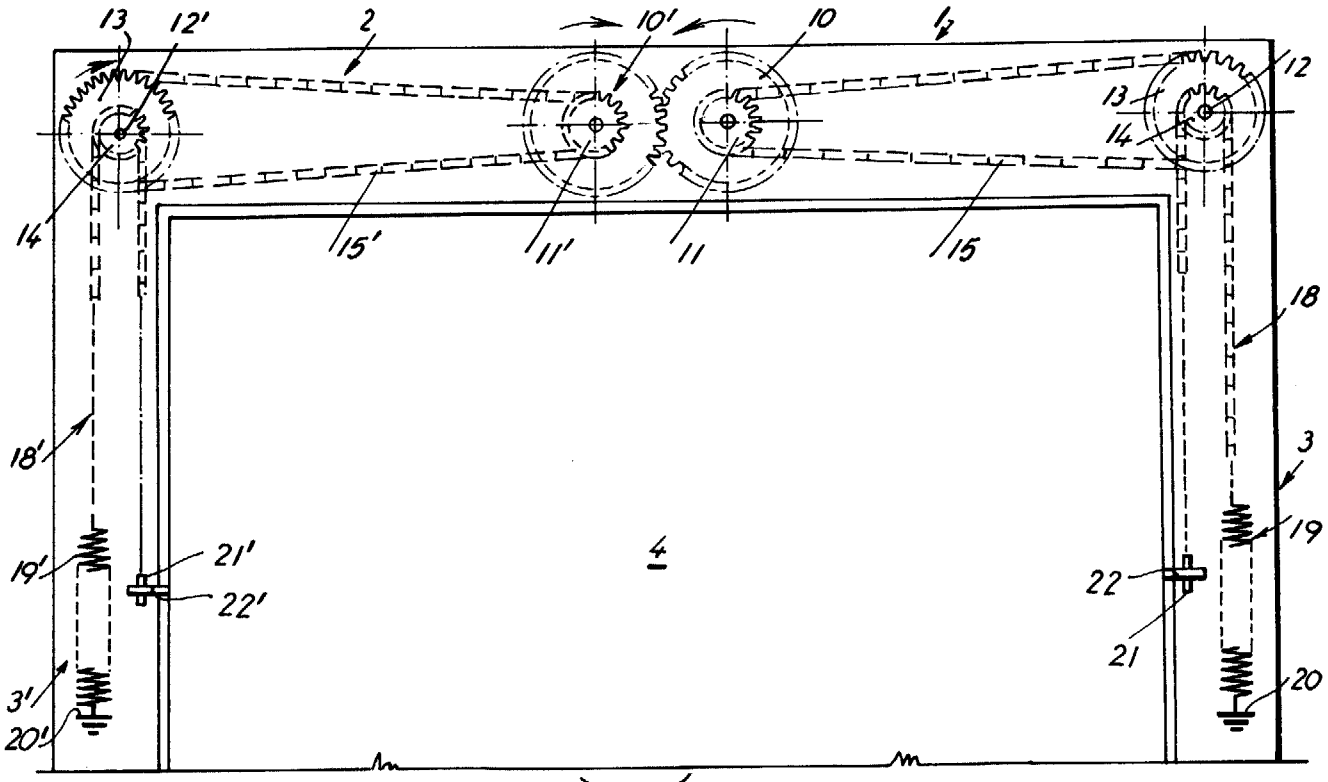
FIG. 1 is a schematic rear elevation cross-section showing the arrangement of the transmission components within the hollow upper frame member and the hollow door jamb members.

Referring first to FIG. 1, it may be seen that the integral unit of this invention comprises a frame indicated in general at 1 and having an upper frame member 2 and corresponding door jamb members 3 and 3'. The upper frame member 2 and the door jambs members 3 and 3' are hollow members suitable to enclose therewithin the components of the driving mechanism.

With said frame 1 cooperates a raisable and tiltable door panel member indicated in general at 4. The movement of this door panel member 4 will be described later on in connection with FIG. 3.

Figure 2:
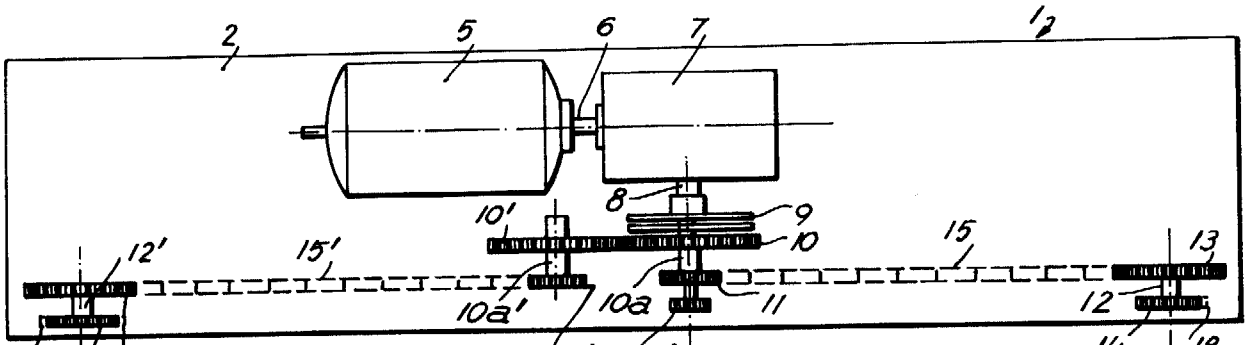
FIG. 2 is a schematic upper view showing the arrangement of the electric driving motor and other components of the driving mechanism within the hollow upper frame member.

As can be seen better in FIG. 2, within the upper frame member 2 an electric driving motor 5 is fixedly mounted. This motor 5 has an output shaft 6 coupled to the input shaft of a reduction gear-box 7 having an output shaft 8. It must be noted that the driving motor 5 and the reduction gear-box 7 are fixed on a wall of the upper frame member with their coupling shaft 6 parallel to the longitudinal axis of said upper frame member, while the output shaft 8 of the reduction gear-box is directed perpendicularly to said longitudinal axis of the upper frame member. On the free end of the output shaft 8 clutch means 9 are provided. Aligned with the output shaft 8 and clutch means 9 another shaft **10*a* is freely rotatably mounted in the upper frame member and has mounted thereon a first gear wheel 10 and a first chain pinion 11, said shaft 10*a* being coupled to the output of the clutch means 9. Another shaft 10*a'* is also freely rotatably mounted in the upper frame member and has fixedly mounted thereon a second gear wheel 10' and a second chain pinion 11', the shaft 10a' being parallel to shaft 10a. The distance between shafts 10a and 10a' is such that the teeth of both gear wheels 10 and 10' will mesh. At each end of the upper frame member 2 respective shafts 12 and 12' are freely rotatably mounted. On each of these shafts 12 and 12' corresponding first and second chain wheels 13 and 13' and corresponding third and fourth chain pinions 14 and 14' are fixedly mounted. A first linear flexible transmission member 15, which in this embodiment is a chain, is closed upon itself and passes around the first chain pinion 11 and first chain wheel 13, while a second linear flexible transmission member 15' like a chain is closed upon itself and passes around the second chain pinion 11' and the second chain wheel 13' (see also FIG. 1**).

In the preferred embodiment shown on the drawings the linear transmission members 15 and 15' are chains and the wheels 13 and 13' and the pinions 11, 11', 14 and 14' are toothed wheels and pinions. However it will be obvious to the skilled in the art that said components 13, 13', 11, 11', 14 and 14' could be replaced by corresponding pulleys in which case the linear transmission members 15 and 15' would be cables (preferably metallic cables) or belts (preferably V belts).

It will be noted that each pair of shaft, chain wheel and chain pinion 12-13-14 and 12'-13'-14' is arranged so as to be vertically aligned with the interior hollow space of the door jamb members 3 and 3', respectively. A third linear flexible transmission member 18, which in the preferred embodiment shown on the drawings is a chain, passes around chain pinion 14, its two hanging sections having free ends hanging within the hollow space of the door jamb member 3. A fourth linear flexible transmission member 18, which in the present embodiment is a chain, passes around chain pinion 14', its two hanging sections having free ends hanging within the hollow space of the door jamb member 3'. The free end of the section of the third chain 18 which is nearer to the outer lateral face of door jamb member 3 is anchored at a fixed point 20 within said door jamb member through a first spring member 19, while the free end of the section of the fourth chain 18' which is nearer to the outer lateral face of door jamb member 3' is anchored at a fixed point 20' within this door jamb member through a second spring member 19'. The free end of the other section of the third chain 18 is connected at 21 to one end of a first driving pin 22 the other end of which is connected to the corresponding lateral edge of the door panel member 4, while the free end of the other section of the fourth chain 18' is connected at 21' to one end of a second driving pin 22' the other end of which is connected to the other lateral edge of the door panel member 4.

It will be noted that all the components of the driving mechanism, such as the electric motor 5, reduction gear-box 7, clutch means 9, gear wheels 10 and 10', chain pinions 10a, 10a', 14 and 14', chain wheels 13 and 13', chains 15, 15', 18 and 18', driving pins 22 and 22', and spring members 19 and 19' are arranged within the frame 1 in such a way as to require a minimum thickness of the upper frame member and the door jamb members to house them. Furthermore the components 5,7, 9, 10, 10', 10a, 10a', 13, 13', 14, 14', 18, 18', 19 and 19' are totally enclosed within the inner space of the hollow upper frame member 2 and door jamb members 3 and 3'. Thus no moving parts are exposed to the outside of said frame, except the outer ends of the drivings pins 22 and 22'. However, these latter are substantially hidden between the corresponding door jamb members 3 and 3' and the door panel member 4.

As has been already mentioned above, the chains 15 and 15' may be substituted by cables (not shown; preferably metallic cables) in which case the chain pinions 11 and 11' and the chain wheels 13 and 13' will be substituted by corresponding cable pulleys (not shown); or the chains 15 and 15' may be substituted by belts (not shown; preferably V belts) in which case the chain pinions 11 and 11' and the chain wheels 13 and 13' will be substituted by belt pulleys (not shown; preferably V grooved).

In the same way the chains 18 and 18' may be substituted by cables or belts and the chain pinions 14 and 14' may be substituted by cable or belt pulleys. Only one or the other of said pairs of chains, or both pairs, may be substituted.

The use of the clutch means 9 is very convenient, but it is not essential for the present invention. Thus it must be considered as an optional feature. The clutch means may be controlled by simple means such as a knob which may be operated by hand, but which may be reached only from the inside of the space protected by the door panel member. However a better arrangement is to provide clutch control means provided with a safety lock which is operable only by a specific key.

Figure 3:
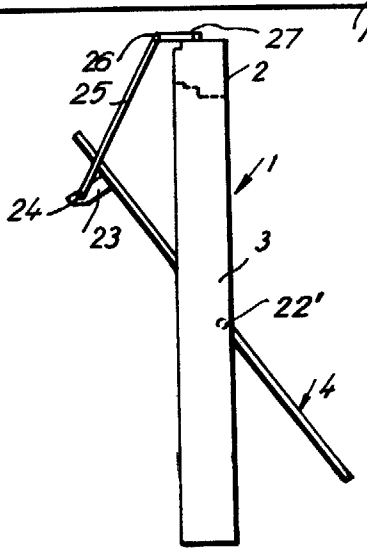
FIG. 3 is a schematic side elevation view showing the door panel member in an intermediate position between its fully closed position and its fully open position.

To obtain not only the vertically rising movement of the door panel member 4, but simultaneously also its tilting movement as can be seen in FIG. 3, a rigid restraining link member 25 is provided. On the upper face of the upper frame member 2 a support member 27 is provided which projects slightly therefrom towards the interior of the place which must be closed and protected by the integral unit of this invention. To the projected free end of this support member 27 is pivotally connected at 26 the upper end of the rigid restraining link member 25. To the door panel member 4 is fixed another support member 23 to which the lower end of link member 25 is pivotally connected. Thus when the driving mechanism lifts the driving pins 22 and 22' these move the door panel member 4 upwardly. But at the same time the rigid link member 25 opposes this upward movement and compels the door panel member to tilt with its upper edge inwardly and its lower edge outwardly with respect to the place protected by the integral unit, simultaneously with the raising movement of the door panel member. The provision and arrangement of the rigid restraining link member 25 is very similar, although not identical, to other known arrangements provided for a similar purpose; thus it is not claimed herein as a novel feature.

It will be obvious to the skilled in the art that while a presently preferred embodiment of the invention has been described and illustrated, it will be possible to introduce some changes of details and substitutions of components without altering the true spirit and scope of the invention as defined in the claims.

I claim:

1. An integral unit comprising a raisable and tiltable door panel member and a frame structure therefor containing a driving mechanism, the frame comprising an upper frame member and two corresponding door jamb members, and a door panel member which may be raised and simultaneously tilted from its lowered vertical closing position to a raised substantially horizontal opened position, and vice versa, in response to the operation of the driving mechanism, the tilting movement being obtained by means of at least one rigid restraining link member pivotally connected at its upper end to the upper frame member and at its lower end to a corresponding lateral edge of the door panel member at a point located higher than the point at which the lifting force of the driving mechanism is applied, wherein said upper frame member and said door jamb members are hollow and said driving mechanism comprises: (a) an electric driving motor having a shaft; (b) a reduction gear-box having an input shaft, said input shaft being coupled to the driving motor shaft; (c) a first pair of linear flexible transmission members closed upon themselves, each forming a substantially horizontally running closed loop having an inner end near the central region of the upper frame member and an outer end near a corresponding outer end region thereof, the inner end being drivingly coupled to said gear-box output shaft; (d) a second pair of linear flexible transmission members, each forming an upper loop and having two free ends hanging vertically within said hollow door jamb members, the upper loop being drivingly coupled to said outer of the loop of a corresponding one of said first pair of linear flexible transmission members; (e) a pair of drive coupling members coupling a first of said two free ends of a corresponding one of said second pair of linear flexible transmission members to the corresponding lateral edge of the door panel member at the point thereof to which the lifting force must be applied; and (f) a pair of weight compensating members to each of which the other of said two free ends of a corresponding one of said second pair of linear flexible transmission members is connected; all the components (a) to (f) being entirely contained within the inner spaces of said upper frame member and door jamb members, except that only one end of each of said drive coupling members (e) project through a corresponding longitudinal slot provided along the face of the respective door jamb member opposing said door panel member.

2. An integral unit comprising a raisable and tiltable door panel member and a frame structure therefor containing a driving mechanism, the frame comprising an upper frame member and two corresponding door jamb members, and a door panel member which may be raised and simultaneously tilted from its lowered vertical closing position to a raised substantially horizontal opened position, and vice versa, in response to the operation of the driving mechanism, the tilting movement being obtained by means of at least one restraining link member pivotally connected at its upper end to the upper frame member and at its lower end to a point of a corresponding lateral edge of the door panel member at a point located higher than the point at which the lifting force of the driving mechanism is applied, wherein said upper frame member and said door jamb members are hollow, and said driving mechanism comprises: (a) an electric driving motor having a shaft, the motor being mounted within said upper frame member on a wall thereof its shaft being parallel to the longitudinal axis of the frame member; (b) a reduction gear-box having and input shaft and an output shaft, the first one being aligned with and connected to said shaft of the electric driving motor, the output shaft of the reduction gear-box being perpendicular to its input shaft; (c) a first and a second auxiliary shafts freely rotatably mounted within said upper frame member, the first one being coupled to said gear-box output shaft, a first and second gear wheel each respectively fixedly mounted on a corresponding one of said auxiliary shafts, the teeth of both gear wheels meshing together, and a first and a second chain pinions each respectively fixedly mounted on a corresponding one of said auxiliary shafts; (d) a third and a fourth auxiliary shafts freely rotatably mounted within said upper frame member, a first and a second chain wheels being respectively fixedly mounted on a corresponding one of said third and fourth auxiliary shafts, and a second and a third chain pinions being respectively fixedly mounted on a corresponding one of said third and fourth auxiliary shafts, these latter being mounted so as to be vertically aligned with the hollow space of said door jamb members; (e) a first and a second chains each one forming a closed loop and passing around a respective one of said first and second chain pinions and a respective one of said first and second chain wheels; (f) a third and a fourth chains each forming an open loop the upper bend of which passes around a respective one of said third and fourth chain pinions, the free ends of each loop hanging vertically within the hollow space of the respective one of said door jamb members, and a first and a second weight compensating members each one connected to one of the free ends of a respective one of said open loops; (g) a first and a second driving pin members, each one connected to the other of said free ends of the respective one of said open loops, each one of said driving pin members slidably projecting through a guide slot provided along the face, of the respective door jamb member, opposed to the corresponding lateral edge of said door panel member, the projected end of each of said driving pin members being coupled to the corresponding lateral edge of the door panel member; all components (a) to (f) being entirely contained within the hollow space of said upper frame member and door jamb members.

3. An integral unit according to claim 2, wherein the coupling of said first auxiliary shaft with the output shaft of said reduction gear-box comprises clutch means having control means for selectively connecting and disconnecting said clutch means.

4. An integral unit according to claim 2, wherein the coupling of said first auxiliary shaft with the output shaft of said reduction gear-box comprises clutch means having control means for selectively connecting and disconnecting said clutch means and arranged such as to be reachable only from the inside of the space protected by said door panel member.

5. An integral unit according to claim 2, wherein the coupling of said first auxiliary shaft with the output shaft of said reduction gear-box comprises clutch means having control means for selectively connecting and disconnecting said clutch means and arranged such as to be reachable only from the inside of the space protected by said door panel member and furthermore comprising safety lock means which are operable only by an exclusive key.

6. An integral unit according to claim 2, wherein each of said weight compensating members is a spring means having one of its ends fixed to said one free end of the respective one of said open loops and having its other end anchored to a fixed point substantially near the lower end of the hollow space of the corresponding one of said door jamb members.

7. An integral unit according to claim 2, wherein each of said weight compensating members is a weight balancing mass suspended from said one free end of the respective one of said open loops within the hollow space of the corresponding one of said door jamb members.

* * * * *